United States Patent [19]

Goldsmith

[11] Patent Number: 4,854,261

[45] Date of Patent: Aug. 8, 1989

[54] COMBINATION SEAT FOR BOATS

[75] Inventor: Howard G. Goldsmith, Cranston, R.I.

[73] Assignee: Todd Enterprises, Inc., Cranston, R.I.

[21] Appl. No.: 177,596

[22] Filed: Apr. 5, 1988

[51] Int. Cl.[4] ..... A47C 17/64

[52] U.S. Cl. ..... 114/343; 297/193; 312/50; 114/270

[58] Field of Search ..... 114/343, 363, 188, 270; 297/188, 192, 193, 217; 5/118, 308; 312/237; 296/156, 124, 240

[56] References Cited

U.S. PATENT DOCUMENTS

| | | | |
|---|---|---|---|
| 2,971,568 | 2/1961 | Rorie et al. | 297/193 |
| 3,722,011 | 3/1973 | Miller | 297/193 |
| 4,766,621 | 8/1988 | Rasor | 114/343 |

*Primary Examiner*—Joseph F. Peters, Jr.
*Assistant Examiner*—Edwin L. Swinehart
*Attorney, Agent, or Firm*—Salter & Michaelson

[57] ABSTRACT

A combination seat for boats includes a housing comprising lower and upper housing sections, a seating assembly mounted on the upper housing section and a galley assembly mounted in the lower housing section, the galley assembly including a sink, a water supply tank, a water dispenser pump and a thermally insulated container member. The seating assembly is adapted to be moved between an erected position wherein it defines a pair of back-to-back seats and a collapsed position wherein it defines a substantially flat sleeping platform, and the upper housing section and the seating assembly are upwardly hingeable to provide access to the galley assembly.

2 Claims, 2 Drawing Sheets

COMBINATION SEAT FOR BOATS

BACKGROUND AND SUMMARY OF THE INVENTION

The instant invention relates to pleasure boats and more particularly to a combination seat for adapting small pleasure boats to include seating, sleeping and galley facilities.

It has been found that it is generally important to make the maximum use of all available space on small pleasure boats, such as those in the 15–25 ft. range. It has been further found that the owners of many small pleasure boats often have the need or desire to take overnight cruises during which they prefer to eat and sleep on their boats. Accordingly, it has been found that there is a need for many relatively small boats to include both sleeping and galley facilities. However, heretofore due to the limited availability of space, it has not been possible or practical to adapt many small boats to include effective sleeping and galley facilities.

The instant invention provides an effective and compact combination device which is operative for adapting relatively small pleasure boats to include seating, sleeping and galley facilities. Specifically, the instant invention provides a combination seat comprising a housing including a lower housing section having a sidewall portion and an upwardly facing upper wall portion, and an upper housing section which is connected to the lower housing section in a manner which permits the housing to be moved between a closed position wherein the upper housing section is received in substantially covering relation on the lower housing section, and an open position wherein the upper wall of the lower housing section is exposed. The combination seat further comprises a sink which is mounted in the upper wall of the lower housing section, a water tank which is received in the lower housing section, water dispensing means which is connected to the water tank for dispensing water into the sink, and a thermally insulated container member which is mounted in the lower housing section and adapted for receiving articles therein. The combination seat further comprises setting means mounted on the upper housing section for supporting a person in a seated position on the housing when the housing is in the closed position thereof. Further, the thermally insulated container member is preferably mounted in the upper wall of the lower housing section, and it preferably opens upwardly for receiving articles therein; and the upper and lower housing sections are preferably hingeably connected for movement between the open and closed positions thereof. The combination seat preferably further comprises means for draining water from the sink and for passing it outwardly through the lower housing section, and the seating means preferably comprises hingeably connected first and second seats, each including hingeably connected seat and back portions. The first and second seats are preferably alternatively positionable in an upright first position wherein the back portions thereof are in adjacent back-to-back relation, or a collapsed second position wherein the back portions are overlaid on the upper housing section so that the back portions cooperate with the seat portions to define a substantially horizontal sleeping platform. The combination seat preferably further comprises a compartment in the upper housing section including a door portion for covering an access opening in the compartment, and the compartment is preferably formed so that the access opening faces downwardly toward the lower housing section when the housing is in the closed position thereof. Still further, the housing preferably comprises a paper towel dispenser in the upper housing section which also faces downwardly toward the lower housing section when the housing is in the closed position thereof.

Accordingly, it is seen that the instant invention provides an effective combination seat for adapting small boats to include seating, sleeping, and galley facilities. The seat portion of the combination seat is adapted to be alternatively positioned in a seating position wherein the back portions of the seats are disposed in back-to-back relation, or a sleeping position wherein the back portions are overlaid on the upper housing section so that they cooperate with the seat portions to define a sleeping platform. Further, the housing is adapted to be alternatively positioned in a closed position or an open position; and when the housing is in the open position, the galley facilities in the housing are readily accessible.

Devices representing the closest prior art to the instant invention of which the applicant is aware are disclosed in the U.S. Pat. Nos. to JAMES, 1,077,199; BROWN, 2,993,529; WOODRUFF SR., 3,099,482; DAZIEL, 3,379,471 and STAHEL, 4,146,279. However, since these references fail to teach a device which can be effectively utilized for adapting a relatively small boat to include seating, sleeping and galley facilities in the manner of the combination seat of the instant invention, they are believed to be of only general interest.

Accordingly, it is a primary object of the instant invention to provide an effective combination seat for adapting small boats to include seating facilities, sleeping facilities and galley facilities.

Another object of the instant invention is to provide a combination seat for small boats comprising a housing containing a sink, a water supply, and a thermally insulated container.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
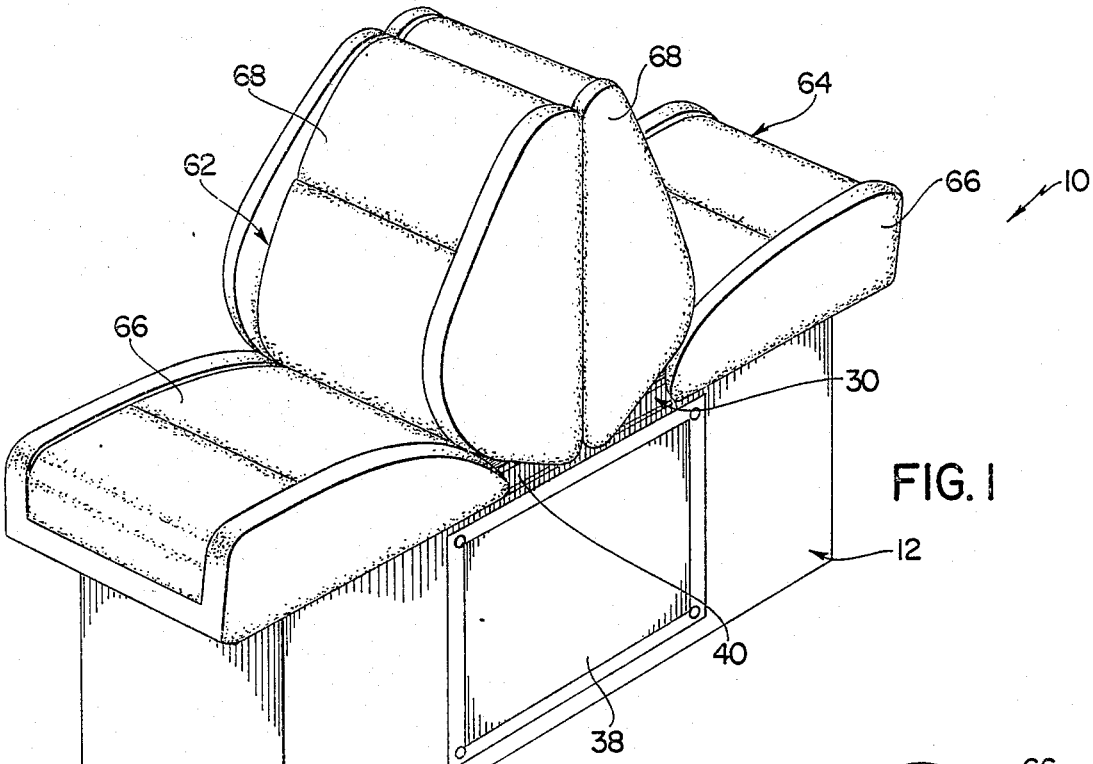
FIG. 1 is a perspective view of the combination seat of the instant invention with the housing in the closed position thereof.

Referring now to the drawings, the combination seat of the instant invention is illustrated and generally indicated at 10 in FIGS. 1–4. The seat 10 comprises a housing generally indicated at 12; and it further comprises a sink 14, a water tank 16, a water dispenser 18, and an insulated container member generally indicated at 20, all of which are mounted in the housing 12. The combination seat 10 further comprises a compartment member generally indicated at 22, and a paper towel dispenser 24, which are also mounted in the housing 12, and a seating assembly generally indicated at 26 which is mounted on the housing 12. The housing 12 comprises lower and upper housing sections generally indicated at 28 and 30, respectively, and it is adapted to be alternatively positioned in the open position illustrated in FIG. 2 wherein the upper housing section 30 is hinged upwardly from the lower housing section 28 or the closed position illustrated in FIGS. 1 and 3, wherein the upper housing section 30 is received in substantially covering relation on the lower housing section 28. When the housing 12 is in the open position thereof, the sink 14, the water dispenser 18, the insulated container member 20, the compartment 22, and the paper towel dispenser 24 are readily accessible, whereas when the housing 12 is in the closed position thereof, the seating assembly 26 can be effectively utilized for supporting one or more persons on the housing 12. Further, the seating assembly 26 is adapted to be alternatively positioned in the upright position illustrated in FIGS. 1, 2 and 3 wherein it defines a pair of seats which are positioned in back-to-back relation, or the collapsed position illustrated in FIG. 4 wherein the seating assembly 26 defines a substantially flat, cushioned sleeping platform.

Figure 2:
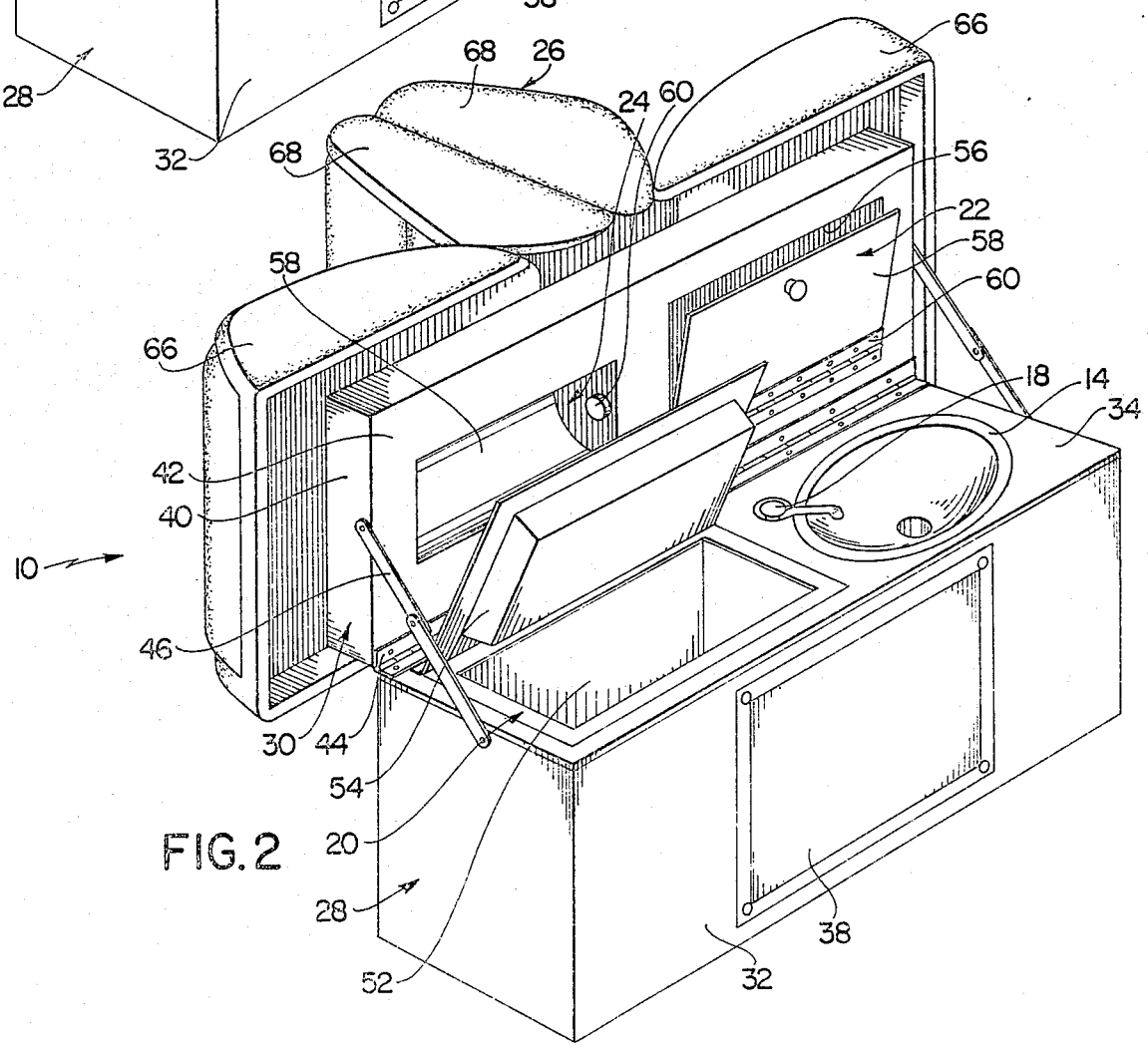
FIG. 2 is a perspective view of the combination seat with the housing in the open position thereof.

The lower housing section 28 preferably comprises a bottom wall (not shown), a peripheral sidewall portion 32, and an upper wall portion 34. The bottom wall (not shown) and the sidewall portion 32 are preferably integrally molded from a suitable fiberglass material so that they cooperate to define a substantially rectangular base structure for supporting the upper wall portion 34. An access opening 36 is provided in the front side of the peripheral sidewall portion 32, and a flexible fabric access panel 38 is detachably secured to the sidewall portion 32 for covering the access opening 36. The upper wall portion 34 is preferably also formed from a suitable fiberglass material and it is secured to the upper extremity of the sidewall portion 32; although, it will be understood that other embodiments of the lower housing section 28, wherein the upper wall portion 34 is integrally formed with the sidewall portion 32 are contemplated. In any event, the upper wall portion 34 is adapted for receiving and supporting the sink 14, the dispenser 18, and the container member 20 therein, as illustrated in FIG. 2 and as will hereinafter be more fully set forth.

The upper housing section 30 is adapted and dimensioned to be received in covering relation on lower housing section 28, and it comprises a peripheral sidewall portion 40, and an upper support wall portion (not shown), both of which are preferably integrally molded from a suitable fiberglass material. The upper housing section 30 preferably further comprises a bottom wall 42 which is preferably also made from a suitable fiberglass material and which is secured to the lower extremity of the peripheral sidewall portion 40; although, other embodiments of the upper housing section 30 wherein the bottom wall 42 is integrally formed with the sidewall portion 40 are also contemplated. The upper housing section 30 is hingeably connected to the lower housing section 28 with a hinge mechanism 44, and a pair of releasable supports 46 are provided for maintaining the upper housing section 30 in an upwardly hinged position. The upper housing section 30 is adapted for receiving the compartment 22 and the dispenser 24 therein as illustrated.

The sink 14 preferably comprises a conventional sink, and it is preferably connected to a drain 48 which passes outwardly through the bottom wall (not shown) of the lower housing section 28. In this regard, it will be understood that other embodiments of the combination seat 10, wherein the sink 14 is integrally molded with the upper wall portion 34 are also contemplated.

The water tank 16 comprises a conventional water tank which is preferably made from a suitable plastic material in either a rigid or a collapsible construction.

The dispenser 18 preferably comprises a conventional manually operable water pump dispenser and it is connected to the water tank 16 through a tubing 50.

The container member 20 preferably comprises a substantially rigid container portion 52 and a cover portion 54. The container portion 52 is preferably made from a suitable material, such as fiberglass, and it preferably includes an outer insulating shell (not shown) for imparting increased insulating properties to the container member 20. The container member 52 is preferably dimensioned for receiving a suitable quantity of food and/or beverages therein, as well as a suitable quantity of ice, and it may include one or more internal partitions (not shown), depending on the particular application. However, other embodiments wherein the container member 52 is also integrally molded with the upper wall portion 34 are contemplated. The cover portion 54 is preferably also made from a suitable, rigid, plastic or fiberglass material in a suitably insulated construction, and it is adapted to be received in covering relation on the container member 52. Further, the cover portion 54 is preferably formed so that the upper surface thereof (not shown) is suitably recessed to provide clearance for a roll of towels contained in the paper towel dispenser 24. In this connection, however, it will be understood that other embodiments of the seat 10 wherein the upper housing section 30 is utilized as a cover for the container portion 52 instead of the cover portion 54 are also contemplated.

The compartment 22 comprises a compartment wall portion 56 which is received in the bottom wall portion 42 of the upper housing section 30 and a door 58 which is hingeably connected to the bottom wall portion 42 with a hinge 60. The compartment 22 is preferably dimensioned for receiving articles, such as table utensils therein, and it preferably includes one or more internal partitions (not shown) for suitably segregating various articles contained therein. The compartment wall portion 56 is preferably made from a suitable, rigid plastic or fiberglass material, and it is preferably integrally molded with the bottom wall portion 42 of the upper housing section 30.

The paper towel dispenser 24 preferably comprises an elongated, half-round dispenser wall portion 58 and a pair of depressible holder buttons 60. The wall portion 58 is preferably dimensioned for receiving a roll of paper towels of conventional size therein so that the buttons 60 are received in the ends of the tubular core of the roll in order to retain the roll of paper towels in the dispenser 24. The wall portion 58 is preferably integrally molded with the bottom wall portion 42 from a suitable, rigid plastic or fiberglass material.

The seat assembly 26 is preferably of conventional construction, and it preferably comprises first and second seats generally indicated at 62 and 64, respectively. Each of the seats 62 and 64 preferably includes hingeably connected, cushioned seat and back portions 66 and 68, respectively, and the seats 62 and 64 are mounted so that the back portions 68 thereof are receivable in back-to-back relation in the manner illustrated in FIGS. 1, 2 and 3. Further, the back portions 68 are preferably hingeably connected adjacent the upper ends thereof to enable the seat assembly 26 to be more easily moved to the collapsed position illustrated in FIG. 4. In this regard, the seat assembly 26 preferably further comprises a pair of spaced track members (not shown), which are mounted on the upper wall of the upper housing section 30; and the seats 62 and 64 are preferably slidably mounted on the track members to enable them to be effectively moved between the erected position and the collapsed position. Means (not shown) is preferably also provided for releasably maintaining the seats 62 and 64 in the erected position illustrated in FIGS. 1, 2 and 3. Accordingly, the seats 62 and 64 can be readily moved to the collapsed position illustrated in FIG. 4, wherein the seat portions 66 thereof are moved outwardly and apart, and the back portions 68 are overlaid on the upper housing section 30. When the seats 62 and 64 are in this position, the back portions 68 cooperate with the seat portions 66 to define a substantially flat, cusioned sleeping platform.

Figure 3:
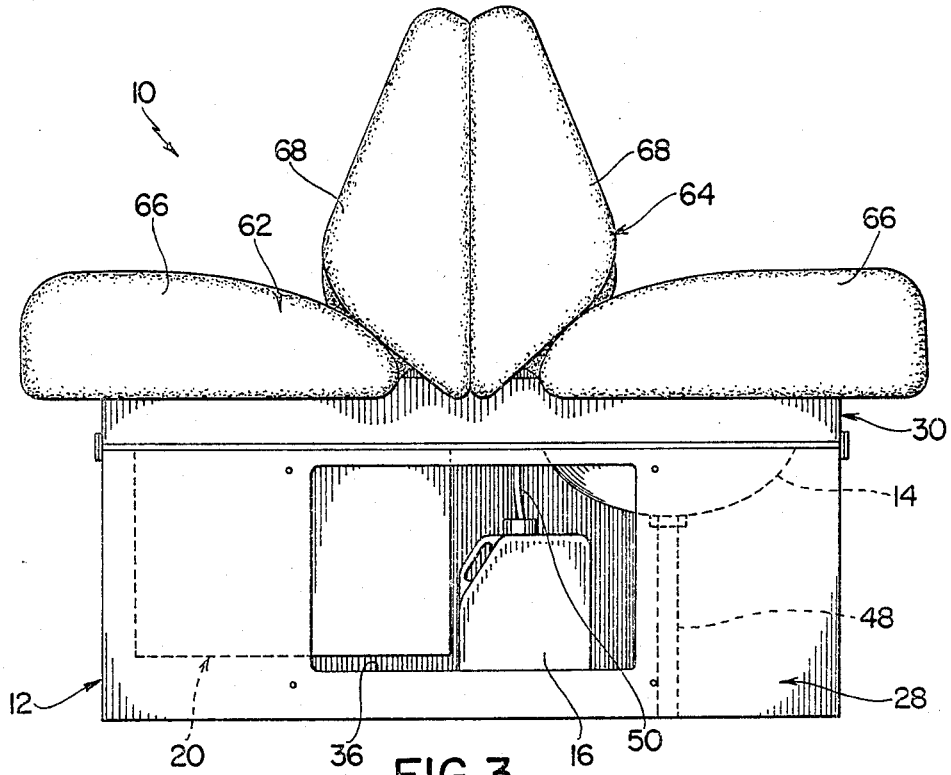
FIG. 3 is a side elevational view of the combination seat with the housing in the closed position thereof and with the access panel removed from the housing.
Figure 4:
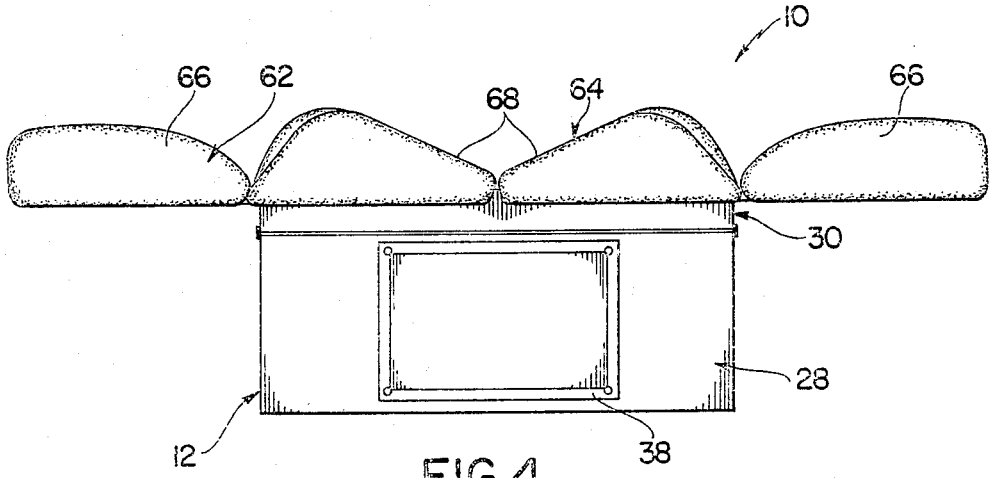
FIG. 4 is a similar view with the seat assembly in the collapsed position thereof.

For use and operation of the combination seat 10, the seating assembly 26 can be effectively utilized in the erected position illustrated in FIGS. 1, 2 and 3, wherein the back portions 68 are in substantially back-to-back relation so that the seating assembly 26 can be effectively utilized for supporting two persons in back-to-back seated positions on the housing 12. Alternatively, the seating assembly 26 can be moved to the collapsed position illustrated in FIG. 3 for providing a cushioned sleeping platform. However, regardless of whether the seating assembly 26 is in the erected position thereof or the collapsed position thereof, the upper housing section 30 can be hinged upwardly to provide access to the sink 14, the dispenser 18, the insulated container member 20, the compartment 22, and the paper towel dispenser 24. The panel 38 can also be removed from the access opening 36 to provide access to the water tank 16, regardless of the position of the upper housing section 30.

It is seen, therefore, that the instant invention provides an effective combination seat for small boats. The combination seat 10 can be effectively utilized for adapting a relatively small boat to include seating, sleeping and galley facilities. Further, the galley facilities contained in the combination seat 10 include a sink 14, a water tank 16, an insulated container member 20, a paper towel dispenser 24, and a storage compartment 22, all of which are readily accessible regardless of the position of the seat assembly 20. As a result, it can be seen that the combination seat 10 represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A combination seat for a boat comprising a housing including hingeably connected lower and upper housing sections, said lower housing section including a sidewall portion and an upwardly facing upper wall portion, said upper housing section being movable between a closed position wherein said upper housing section is received in substantially covering relation on said lower housing section and an open position wherein said upper wall is substantially exposed, a sink mounted in said lower housing section upper wall, a water tank in said lower housing section, dispensing means connected to said water tank for dispensing water from said tank into said sink, a thermally insulated container member in said lower housing section adapted for receiving articles therein and accessible through said lower housing section upper wall and seating means mounted on said upper housing section, said seating means including a back portion and a seat portion and being operative for supporting a person thereon when said upper housing section is in the closed position thereof, and compartment means in said upper housing section, said compartment means having an access opening therein and including a door portion for covering said access opening, said access opening facing downwardly toward said lower housing section when said upper housing section is in the closed position thereof.

2. A combination seat for a boat comprising a housing including hingeably connected lower and upper housing sections, said lower housing section including a sidewall portion and an upwardly facing upper wall portion, said upper housing section being movable between a closed position wherein said upper housing section is received in substantially covering relation on said lower housing section and an open position wherein said upper wall is substantially exposed, a sink mounted in said lower housing section, dispensing means connected to said water tank for dispensing water from said tank into said sink, a thermally insulated container member in said lower housing section adapted for receiving articles therein and accessible through said lower housing section upper wall and seating means mounted on said upper housing section, said seating means including a back portion and a seat portion and being operative for supporting a person thereon when said upper housing section is in the closed position thereof, and paper towel dispensing means in said upper housing section, said paper towel dispensing means facing toward said lower housing section when said upper housing section is in the closed position thereof.

* * * * *